US005774903A

United States Patent [19]

Wilson et al.

[11] Patent Number: 5,774,903

[45] Date of Patent: Jul. 7, 1998

[54] DEVICE FOR DISPENSING A CHEMICAL COMPOSITION INTO A TOILET TANK

[75] Inventors: Victor Edward Wilson, Glenelg East; Lionel Albert Woolford, Kilburn, both of Australia

[73] Assignee: Sara Lee/DE N.V., Utrecht, Netherlands

[21] Appl. No.: 3,673

[22] Filed: Jan. 12, 1993

Related U.S. Application Data

[63] Continuation of Ser. No. 702,037, May 20, 1991, abandoned.

[51] Int. Cl.[6] ..... E03D 9/02

[52] U.S. Cl. ..... 4/227.1

[58] Field of Search ..... 4/227.4, 227.5, 4/227.6, 227.1

[56] References Cited

U.S. PATENT DOCUMENTS

| | | | |
|---|---|---|---|
| 1,321,586 | 11/1919 | Bachman | 4/222 |
| 3,424,182 | 1/1969 | Klasky | 4/227.6 |
| 3,769,640 | 11/1973 | Castronovo | 4/227.6 |
| 4,277,853 | 7/1981 | McDuffee | 4/228 |
| 4,416,854 | 11/1983 | Nielsen | 4/228 X |
| 4,962,549 | 10/1990 | King | 4/228 |

FOREIGN PATENT DOCUMENTS

| | | | |
|---|---|---|---|
| 240459 | 2/1961 | Australia | 4/228 |
| 261095 | 5/1963 | Australia . | |
| 288230 | 1/1969 | Australia . | |
| 1918483 | 8/1987 | Australia . | |
| 0140692 | 5/1985 | European Pat. Off. . | |
| 0168075 | 1/1986 | European Pat. Off. . | |
| 0180451 | 5/1986 | European Pat. Off. . | |
| 2589498 | 5/1987 | France . | |
| 2916247 | 10/1980 | Germany | 4/227.4 |
| 6502895 | 9/1966 | Netherlands | 4/228 |
| 13146 | of 1893 | United Kingdom | 4/228 |
| 8924 | of 1893 | United Kingdom | 4/228 |
| 0009959 | of 1894 | United Kingdom | 4/227.5 |
| 23517 | of 1909 | United Kingdom | 4/227 |
| 2067409 | 7/1981 | United Kingdom . | |
| 2098253 | 11/1982 | United Kingdom . | |

*Primary Examiner*—Robert M. Fetsuga

*Attorney, Agent, or Firm*—IP Group of Pillsbury Madison & Sutro LLP

[57] ABSTRACT

A passive dispensing device for use in dosing a toilet bowl with water treatment material including a housing forming a chamber which is adapted to hold water treatment material. A reservoir is provided within the housing for holding water containing the water treatment material. A water flow path is provided between the chamber and the reservoir. A water flow passageway is provided extending upwardly away from the reservoir. The passageway has its lower end in communication with the reservoir at or adjacent its bottom wall, and its open upper end in flow communication with the toilet tank interior. The upper end of the passage way is located below the upper edge of the housing (and below the level of the water within the cistern when full). As a result, water, during the filling of the toilet tank will flow into the reservoir upwardly along the water flow path and into the chamber, via the passageway. When the cistern is flushed, a portion only of the water within the passive dispensing device (and containing said water treatment material) is discharged into the toilet tank via the passageway.

8 Claims, 2 Drawing Sheets

DEVICE FOR DISPENSING A CHEMICAL COMPOSITION INTO A TOILET TANK

This is a continuation of application Ser. No. 07/702,037, filed on May 20, 1991 which was abandoned upon the filing hereof.

This invention relates to an improved dispensing device for use in the cistern (i.e., the holding tank for water for the next flushing operation of the toilet) of a toilet system, wherein the device incorporates a chemical additive, such as a disinfecting and/or deodorising compound, which is arranged to disperse in water present in the device so that water containing the compound is delivered automatically to the toilet bowl when the cistern is emptied.

Many different forms of toilet cistern dispensing devices are known in the art. In this regard, reference is made to Australian Patent Specification Nos. 564163, 261095, 288230 and U.S. Pat. No. 3,604,020. One of the problems associated with the prior art dispensing devices is that the water treatment material or additive (normally in solid form) tends to disintegrate and erode away relatively quickly. This is undesirable in that the working life of the device (normally, in "throw-away" form) is not very long, and also leads to excessive amounts of chemical material being charged with the flushing water resulting, in staining of the toilet bowl, which is aesthetically unattractive, particularly when the toilet is flushed after a prolonged quiescent period.

SUMMARY OF THE INVENTION

The present inventors have recognised that in order to effectively cleanse, disinfect and/or deodorise the flushing water of a tank type toilet, only a small amount of water treatment material or additive is needed to be mixed with the flushing water from the toilet tank.

It is an object of the present invention to provide an improved toilet cistern dispensing device wherein the rate of dispersal of the water treatment material contained in the cistern is more efficiently controlled in comparison to prior art devices, which in turn results in the working life of the water treatment material being significantly extended.

It is a further object of the present invention to provide a toilet flushing dispensing device which is of extremely simple design, of low cost and can be readily fitted to and removed from a toilet cistern system.

It is a further object of the present invention to provide an improved dispensing device wherein use is made of a removable cartridge containing the water treatment material, whereby, upon the material being fully consumed, one need only insert a replacement cartridge, without having to remove the device in its entirety.

According to this invention therefore, an improved passive dispensing device for use in dosing a toilet bowl with water treatment material comprises a housing forming a chamber which is adapted to hold water treatment material means, reservoir means within the housing for holding a reservoir of water containing the water treatment material, water flow path means between the chamber and the reservoir means, water flow passageway means extending upwardly away from the reservoir means, the passageway means having its lower end in communication with the reservoir means at or adjacent its bottom wall, and its open upper end in flow communication with the cistern interior. The upper end is located below the upper edge of the housing (and below the level of the water within the cistern when full), whereby water, during the filling of the cistern will flow into the reservoir means upwardly along the water flow path means and into the chamber, via said passageway means. When the cistern is flushed, a portion only of the water within the device (and containing the water treatment material) will be discharged into the cistern via the passageway means.

Preferably, the water treatment material means comprises a removable cartridge having a tubular side wall having a plurality of apertures formed therein, the apertures being spaced along the length of the side wall, a closed bottom wall and an open upper end, the interior of the cartridge being filled (or nearly so) with solid water treatment material, the side wall being spaced from the inner walls of the container or housing so as to form the water flow path means.

Preferably, the lower end of the drain tube connects to the reservoir means via an opening in the side wall of the housing, the opening being spaced a small distance, e.g. 5 mm above the bottom wall of the housing.

Preferably, the reservoir means is formed by a space between the cartridge bottom wall and the housing bottom wall so as to permit water to flow freely from the housing into the discharge tube and vice versa.

Preferably, the discharge tube extends upwardly by a distance which is slightly less than half the overall height of the housing or container. The tube may be provided with a flow restrictor in its outlet end for reducing the flow rate of treated water from the device, and in turn the rate of release of the water treatment material.

It will be appreciated that the height of the discharge tube is a factor which determines the volume of water discharged from the device, and that a reservoir of water containing water treatment material, will always be stored within the device, i.e. it never drains completely.

In use, the device is partially immersed in the cistern water to a depth just below the upper end of the housing, whereupon water enters the chamber from the reservoir means, via the discharge tube, and a head of water is formed in the cartridge above the upper level of the water treatment material, which then becomes dispersed or dissolved in the water. Some of the dissolved material will diffuse into the water of the reservoir means ready for discharge into the cistern. When the cistern is flushed, treated water will be dispensed into the cistern once the level of water in the cistern falls, and such discharge will continue until the level of the water in the chamber drops to the level of the upper end of the discharge tube. A reservoir of treated water thus remains in the reservoir means ready for the next flush.

With this arrangement, the water within the dispenser is maintained in a relatively quiet state which minimises the loss of water treatment material, particularly when the toilet is not in use (i.e. during quiescent periods). Preferably, the water within the device contacts substantially only the upper surface of the water treatment material, whereby the rate of release of the material is very much controlled during the flushing/refilling cistern cycles and this significantly extends the working life of the dispensing device (without having to replace the water treatment material), and avoids any problems which normally arise owing to excessive discharge of such material during flushing, e.g. unsightly stains within the toilet bowl.

In a preferred embodiment, as the water treatment material gradually dissolves away and the level of its upper surface slowly drops, further apertures in the side wall of the cartridge are progressively exposed, whereby water which collects within the cartridge during the dispensing cycle of the device, will drain from the cartridge through the exposed apertures and flow downwardly through the annular space between the container side wall and the cartridge and eventually dispense through the discharge tube into the cistern.

The water treatment material may be a solid block, and compositions for same are well known in the art. The composition can contain components for controlling the rate of release of the active material into the water.

Preferably, the material is contained in disposable cartridges, or in a protective wrapping which dissolves in water. Refills can thus be simply inserted in the device without having to remove it from the cistern.

BRIEF DESCRIPTION OF THE DRAWINGS

In order to more fully explain the applicants' invention, an embodiment is described hereunder in some further detail with reference to and illustrated in the accompanying drawings in which.

DETAILED DESCRIPTION

Figure 1:
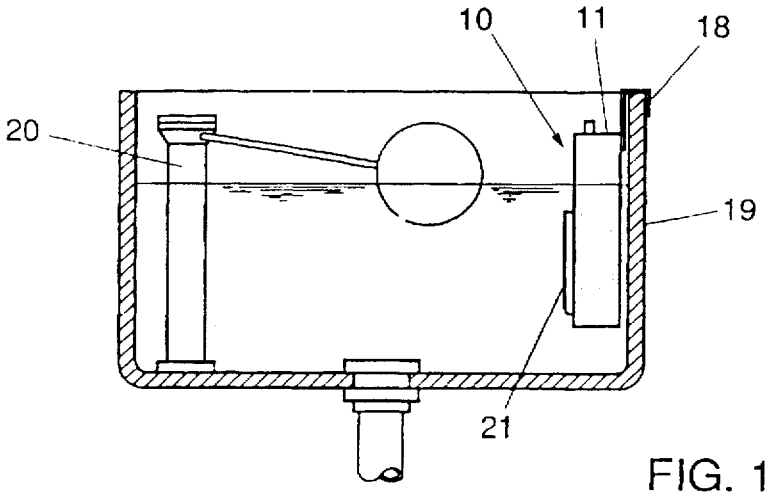
FIG. 1 is a schematic illustration of a dispenser constructed in accordance with the principles of the present invention, installed in a toilet cistern.
Figure 2:
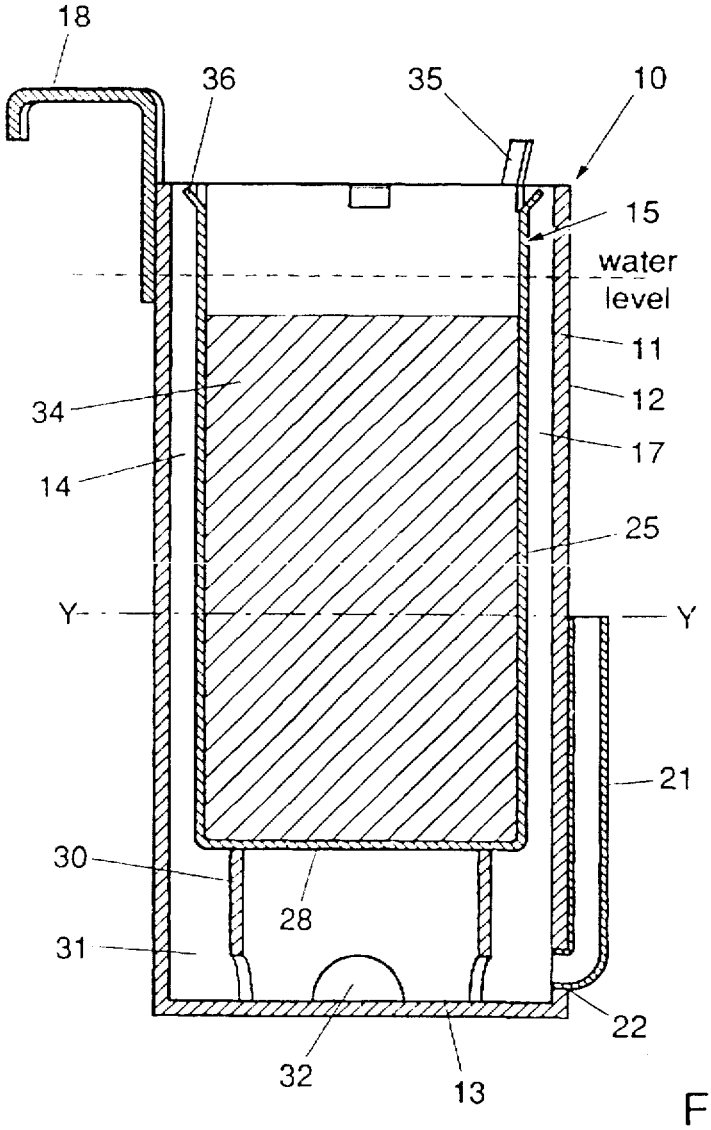
FIG. 2 is a vertical sectional view of the dispenser assembly of this embodiment of the device.
Figure 3:
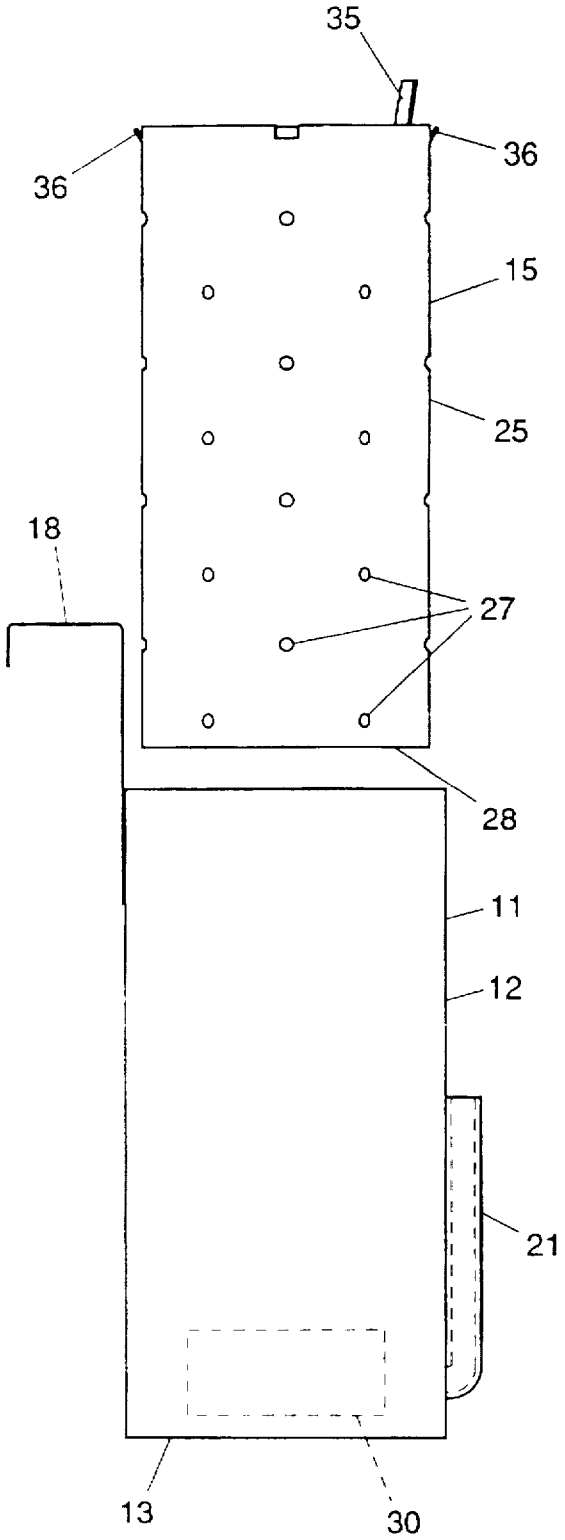
FIG. 3 is an exploded side elevational view of the assembly shown in FIG. 2.
Figure 4:
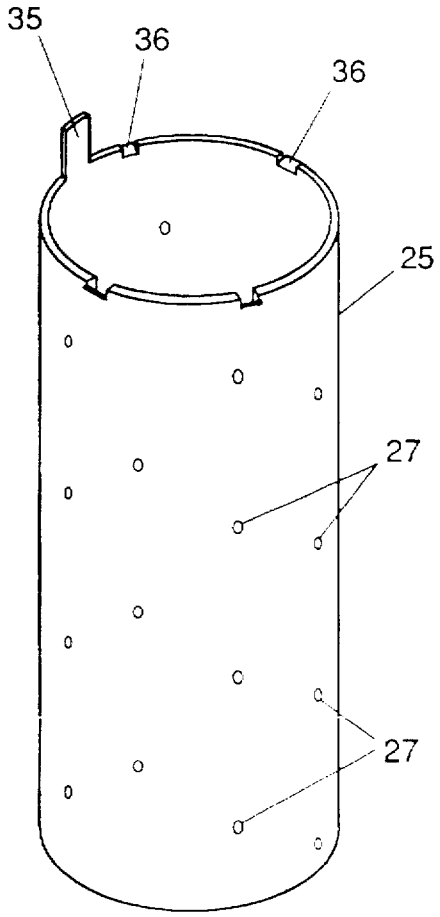
FIG. 4 is a perspective view of the inner cartridge shown in FIG. 3, containing the chemical additive.

In the embodiment of the invention that is shown in FIGS. 1–4, the toilet cistern dispensing device 10 comprises a hollow cylindrical container or housing 11 having a tubular side wall 12 defining a chamber 14, a closed bottom wall 13 and an open top, and a removable cylindrical cartridge 15 which is vertically slidably located within the chamber 14, the housing 11 and cartridge 15 being dimensioned so that with the cartridge 15 housed in the chamber 14, a small annular clearance 17 exists between the side walls thereof.

The housing 11 is formed of water-impervious plastics material, and has attached to its side wall a hanger strap 18, for hookingly attaching the housing 11 to a side wall of the toilet cistern (i.e., flushing tank) 19, or to the inlet tube 20 of the cistern 19, the positioning of the housing 11 being selected so that when the cistern 19 is filled with water, the housing 11 projects slightly above the level of the water in the cistern (refer FIG. 1).

The container 11 is provided with an upwardly extending discharge tube 21 which, in this embodiment, has its lower end connected to an aperture 22 in the side wall 12 of the container 11 near to its bottom wall 13, the tube 21 extending approximately parallel to the side wall 12 of the container 11, exteriorly of the container and contiguous therewith. The tube 21 terminates at its upper end at a level which is slightly below the mid-region of the container 11.

The removable cartridge 15 comprises a cup-shaped outer casing 25 made of plastics material, the diameter of which is slightly less than the diameter of the cylindrical housing 11. The tubular side wall of the casing 25 has a plurality of axially spaced, horizontal rows of apertures 27 formed therein, the apertures 27 in each row being spaced circumferentially around the casing 25, the apertures 27 in each adjacent row being in staggered relationship.

The bottom wall 28 of the casing 25 is closed and sits on top of a support ring 30. The cartridge 15 is thereby supported clear of the bottom wall 13 of the container 11, and above the lower end of the tube 21. The space 31 forms a reservoir for the water which enters the housing 11 through the tube 21. The ring 30 is provided with openings 32 in its side wall to permit water to flow freely through the reservoir 31 into the tube 21 and vice versa.

Water treatment material 34 containing cleansing, colouring, disinfecting and/or perfumed agents, is contained in the cartridge 15, to a level below the upper end of the casing 25, so that a space is formed above the material 34 in the casing 25 and which forms a well in which water can collect. In this initial state, only a small number of the apertures 27 in the outer casing side wall 25 are open or exposed.

In this embodiment, the material is in solid or paste form and fills the interior of the cartridge 15 so that essentially only its upper surface makes effective contact with water, the apertures 27 being sufficiently small so that the contact between the water and the material 34 by virtue of the holes 27, does not have any significant effect on the dissolving or dispersion of the material 34. The material is desirably formulated so that it slowly dissolves in water, the pattern of holes 27 being effective to ensure that the material 34 is consumed evenly, so that its upper surface maintains a substantially flat profile as it slowly drops.

The upper end of the cartridge 15 is provided with a tab 35 which serves as a handle for manually grasping the cartridge 15 to facilitate its insertion and withdrawal from the housing 11, e.g. when a replacement cartridge 15 needs to be installed, without having to remove the device in its entirety.

In use, the dispensing device 10 is suspended in the tank of the toilet cistern 19, for example by simply engaging its hanger strap 18 over the side wall of the cistern 19, the housing 11 being located so that it is immersed over the majority of its length. As the device 10 is immersed in the water within the cistern 19, water enters the housing 11 via the tube 21 and flows upwardly through the gap between the housing side wall 12 and the cartridge side wall 25, and into the interior of the cartridge 15 via the exposed apertures 27, whereupon it comes in contact with the exposed upper surface of the water treatment material 34, the water within the device 10 continuing to rise up to the level of the water in the cistern tank 19.

When the toilet is flushed, a charge of water from the device (containing the water treatment material 34) is displaced through the discharge tube 21 into the cistern 19, whereupon it mixes with the water in the cistern tank and in turn, is flushed into the toilet bowl. If water is emptied from the cistern tank quicker than the rate of discharge of water from the dispensing device, water from the device will also meter into the cistern during the initial stages of refilling. The level of water within the container 11 drops until it coincides with the level of the upper end of the tube 21. Upon the cistern being refilled, the water in the container 11 returns to its previous level.

As the water treatment material 34 is consumed and the level of its upper surface drops, further apertures 27 in the side wall of the cartridge casing 25 become exposed, to thereby permit water collected within the casing to drain therefrom during the flushing cycle. Desirably, water within the housing 11 makes contact with the water treatment material 34 essentially only across its upper surface, thus permitting the rate of dispersion of the water treatment material 34 to be effectively controlled.

In order to maintain the annular gap 17 between the housing 11 and the cartridge 15, the upper end of the casing 25 is provided with out-turned tabs 36 which engage the inner wall of the housing 11. This minimises the likelihood of blockages forming in the flow path between the housing wall 12 and the casing side wall, e.g. caused by build-up of particles from the material 34. Any other form of spacer means constructed so as to centralise the cartridge within the housing may be employed.

In variation to the above described embodiment, the tube or conduit 21 may be formed so as to have a horizontal leg portion which projects into the bottom region of the housing 11 and serves as a support member for the cartridge 15 (in lieu of the ring 30). The horizontal leg portion is preferably formed with holes in its wall, in order to assist water flow into the tube. In another variation, the chamber 14 for receiving the cartridge 15 can be separated from the walls defining the reservoir 31. In yet a further variation, the tube 21 can be formed as an integral part of the wall of the housing (so as to define a passageway) rather than as a separate element.

A brief consideration of the above-described embodiment will indicate that the invention provides for an extremely simple yet very effective toilet cistern dispensing device which allows the water treatment material contained therewithin to be efficiently consumed in a way which greatly extends the working life of the dispensing device (for a given amount of material) and which allows a replacement cartridge to be performed easily and quickly, without having to remove the container or housing for the cartridge from the cistern.

We claim:

1. A passive dispensing device for dosing a tank-type flush toilet, from a toilet tank which, in use, fills with water to a higher fill level, and when flushed, empties to a lower, flushed level, and which toilet tank has a sidewall having an upper edge, said dispensing device comprising:

a water-impervious housing having a sidewall having an upper edge, and a bottom wall, together defining an upwardly open reservoir for water;

means for supporting said housing from said toilet tank so that said upper edge of said housing sidewall is located above said fill level of said toilet tank, but most of said housing extends below said fill level;

a discharge and filling tube associated with said housing, said tube having one end communicating with said reservoir adjacent said bottom wall of said housing, another end communicating externally of housing at a level which is intermediate said fill level and said flushed level of said toilet tank and about halfway said bottom wall and upper edge of said sidewall, and a conduit interconnecting said ends, so that, when the toilet is flushed, water contained in said reservoir will flow out into said toilet tank through said conduit while the water level in said toilet tank is below the water level in said reservoir and water contained in the toilet tank will flow into the reservoir while the water level in said reservoir is below the water level in said toilet tank; and means for supporting in said reservoir a body of water treatment composition which can, while disposed in said reservoir, erode from a surface of such body, into the water contained in said reservoir, for transfer with such water into the toilet tank as water flows out of said reservoir through said tube into said toilet tank;

a body of water-erodible water-treatment composition, in solid or paste form;

said means for supporting said body comprising an upwardly opening casing having a peripheral sidewall and a bottom wall;

said body being disposed in said casing so as to transversally fill said casing up to a level, at which said body has a generally horizontal upper surface;

said sidewall of said casing having a plurality of angularly and vertically spaced openings therethrough;

said casing being removably received in said housing so that said sidewall of said casing, at least partly perimetrically thereabout, is laterally spaced from said sidewall of said housing, and so that at least a part of said reservoir is disposed laterally between said casing and said housing, at least partly perimetrically of said sidewall of said casing;

said generally horizontal upper surface of said body of water-erodible water-treatment composition being located below said fill level of said toilet tank, said side wall of said casing having an upper edge disposed above said fill level of said toilet tank, and at least one of said openings through said sidewall of said casing is disposed above said upper surface of said body of water-erodible water-treatment composition and below said fill level of said toilet tank, so that, in use, the water within the housing makes contact with the said body of water-erodible water-treatment composition essentially only across its upper surface; and said angularly and vertically spaced openings through said side wall being sufficiently small so that, in use, the contact between the water and the said body of water-erodible water-treatment composition by virtue of the said openings does not have any significant effect on the dissolving of the water-erodible water-treatment composition.

2. The dispensing device of claim 1, wherein:

said means for supporting said body in said reservoir is arranged for supporting said body above said bottom wall and above said one end of said tube, so that at least a portion of said reservoir is disposed under the body of water treatment material.

3. The dispensing device of claim 1, wherein:

said sidewall of said housing and said sidewall of said casing are both of generally circular transverse cross-sectional shape; and said device further includes centralizer means disposed between said sidewall of said housing and said sidewall of said casing for maintaining annularity of said reservoir between said sidewall of said housing and said sidewall of said casing.

4. The dispensing device of claim 1, wherein:

said one end of said tube opens externally of said housing at a level which is less than halfway from said bottom wall of said housing to said upper edge of said sidewall of said housing.

5. The dispensing device of claim 1, wherein:

said conduit engages said sidewall of said housing between said ends of said tube.

6. The dispensing device of claim 1, wherein:

said means for supporting said housing from the toilet tank comprise a hanger secured on said sidewall of said housing and configured to hang from the upper edge of the sidewall of the toilet tank.

7. The dispensing device of claim 1, further including:

an upwardly accessible handle provided on said sidewall of said casing, for facilitating vertical manual placement of said casing in said upwardly open reservoir and withdrawal of said casing from said upwardly open reservoir.

8. The dispensing device of claim 1, wherein:

said means for supporting said body in said reservoir is arranged for supporting said body above said bottom wall and above said one end of said tube, so that at least a portion of said reservoir is disposed under the body of water treatment material; and said means for supporting said body in said reservoir comprises a ring formed on said bottom wall of said casing and supported on the bottom wall of said housing; said ring having means defining openings laterally therethrough to permit water to flow freely through said reservoir portion into said tube and from said tube into said reservoir portion.

* * * * *